US009764577B2

(12) United States Patent
Matsumoto

(10) Patent No.: US 9,764,577 B2
(45) Date of Patent: Sep. 19, 2017

(54) INK RIBBON, RIBBON CARTRIDGE, AND PRINTER

(71) Applicant: Brother Kogyo Kabushiki Kaisha, Nagoya-shi, Aichi-ken (JP)

(72) Inventor: Haruki Matsumoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/870,280

(22) Filed: Sep. 30, 2015

(65) Prior Publication Data

US 2016/0152056 A1 Jun. 2, 2016

(30) Foreign Application Priority Data

Nov. 28, 2014 (JP) ..... 2014-242563

(51) Int. Cl.

| | |
|---|---|
| ***B41J 31/00*** | (2006.01) |
| ***B41J 31/02*** | (2006.01) |
| ***B41J 31/06*** | (2006.01) |
| ***B41J 31/08*** | (2006.01) |
| ***B41J 32/00*** | (2006.01) |

(52) U.S. Cl.

CPC ..... *B41J 31/00* (2013.01); *B41J 31/02* (2013.01); *B41J 31/06* (2013.01); *B41J 31/08* (2013.01); *B41J 32/00* (2013.01)

(58) Field of Classification Search

CPC .. B41F 16/00; B41F 16/0006; B41F 16/0026; B41F 16/0033; B41J 2/315; B41J 2/32; B41J 2/325

See application file for complete search history.

(56) References Cited

U.S. PATENT DOCUMENTS

| | | | |
|---|---|---|---|
| 5,294,941 | A | 3/1994 | Yamada et al. |
| 6,132,119 | A | 10/2000 | Nakajima et al. |
| 8,890,915 | B2 | 11/2014 | McNestry et al. |
| 2004/0265030 | A1 | 12/2004 | Uehara |
| 2012/0069125 | A1 | 3/2012 | McNestry et al. |
| 2013/0021423 | A1 | 1/2013 | Tonishi |
| 2014/0002568 | A1 | 1/2014 | McNestry et al. |

FOREIGN PATENT DOCUMENTS

| | | | |
|---|---|---|---|
| EP | 0765760 | A2 | 4/1997 |
| EP | 1776235 | A1 | 4/2007 |
| JP | S6311381 | A | 1/1988 |
| JP | H06-340183 | A | 12/1994 |
| JP | H08-118830 | A | 5/1996 |
| JP | H10-291350 | A | 11/1998 |
| WO | 2006013348 | A1 | 2/2006 |

OTHER PUBLICATIONS

Sep. 20, 2016—(EP) Extended Search Report—App 15185726.5.
Jul. 8, 2016—(EP) Partial Search Report—App 15185726.5.

*Primary Examiner* — Kristal Feggins
(74) *Attorney, Agent, or Firm* — Banner & Witcoff, Ltd.

(57) ABSTRACT

The disclosure discloses an ink ribbon. The ink ribbon includes a ribbon base layer, a first layer, and a second layer. The first layer is configured to separate from the ribbon base layer and is disposed on a first surface of the ribbon base layer. The second layer is configured to adhere to a transfer target and is disposed on the first layer. The melting point of the second layer is 60 [° C.] or more and 90 [° C.] or less.

15 Claims, 11 Drawing Sheets

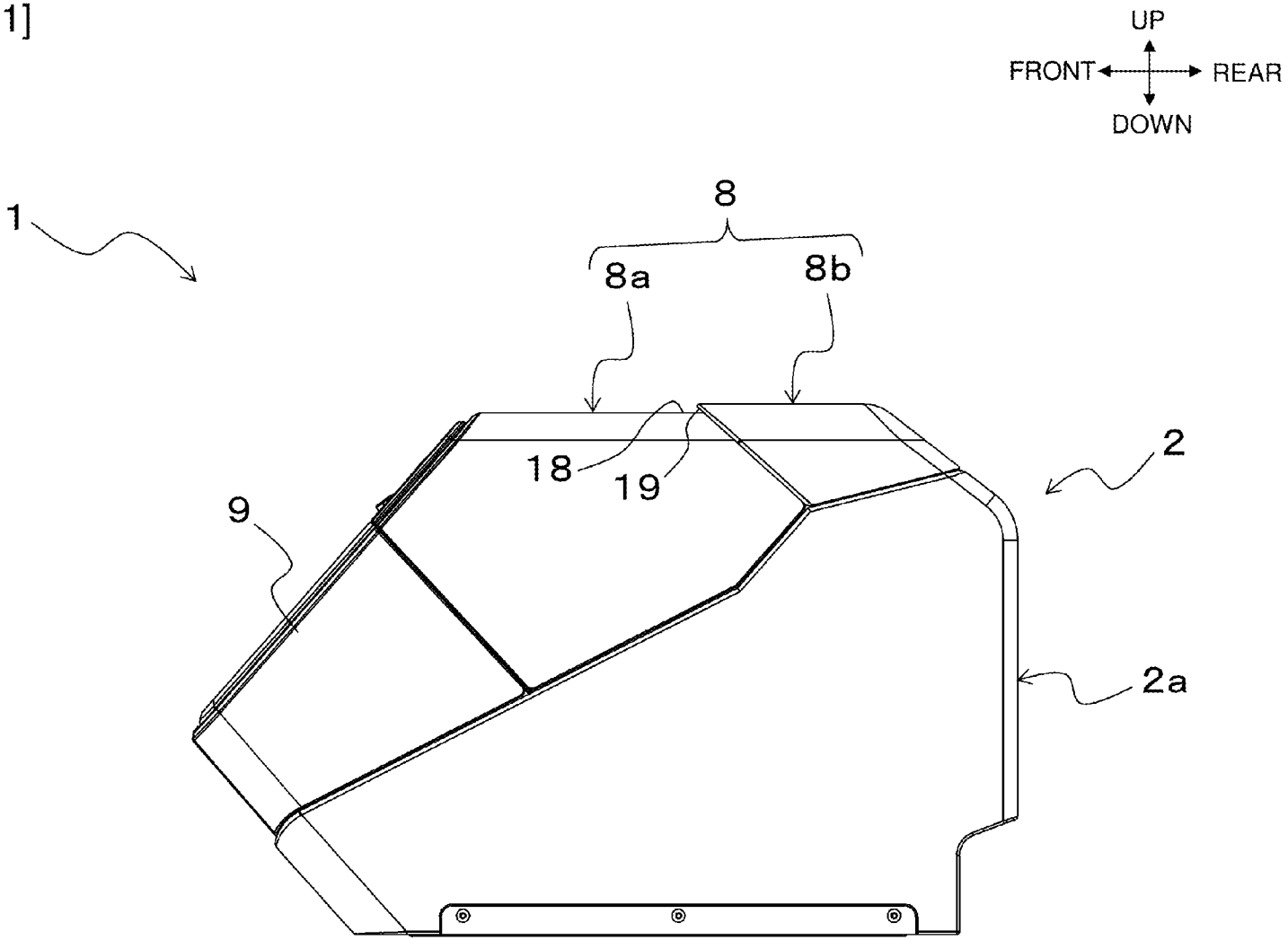
[FIG. 1]

[FIG. 2]
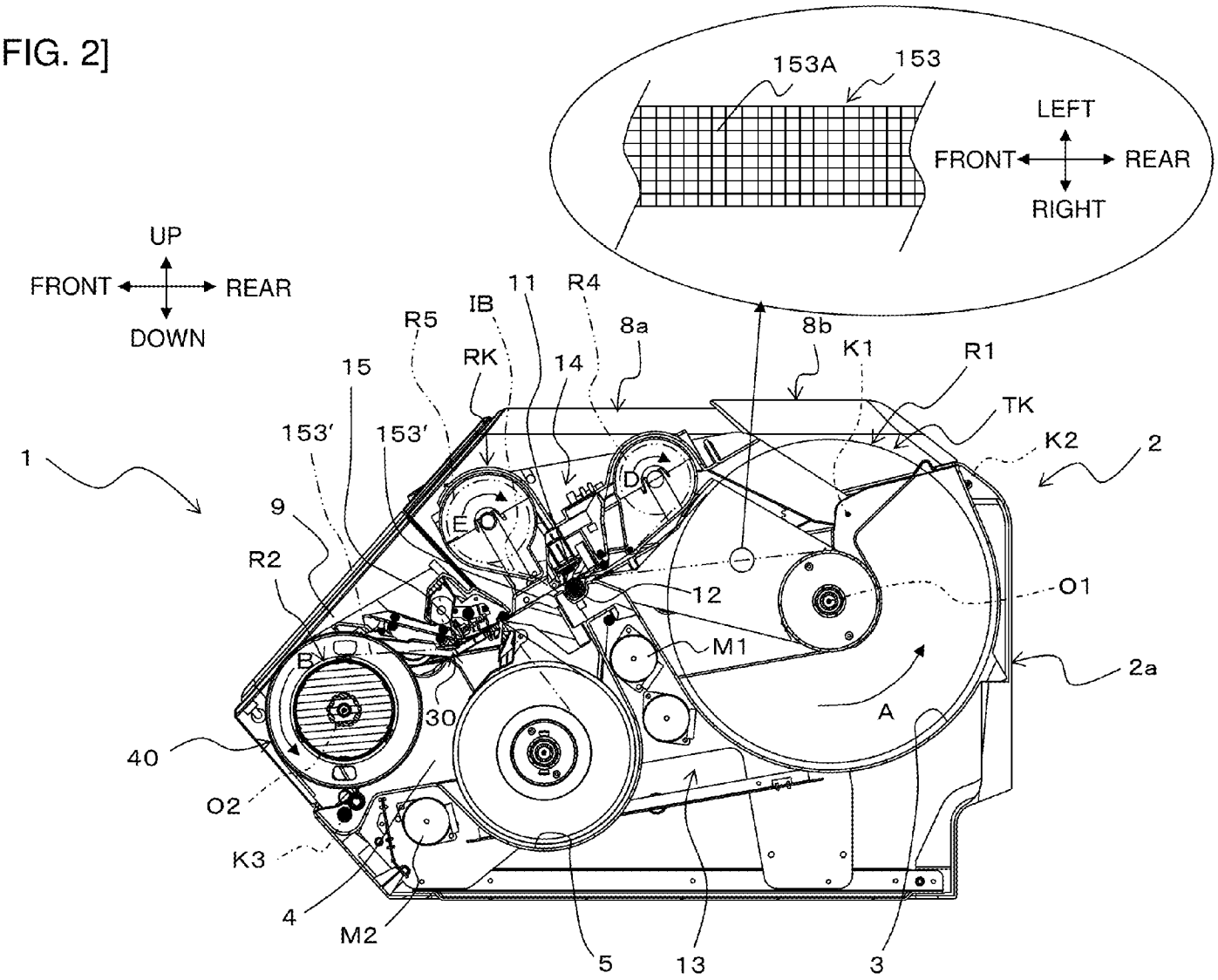

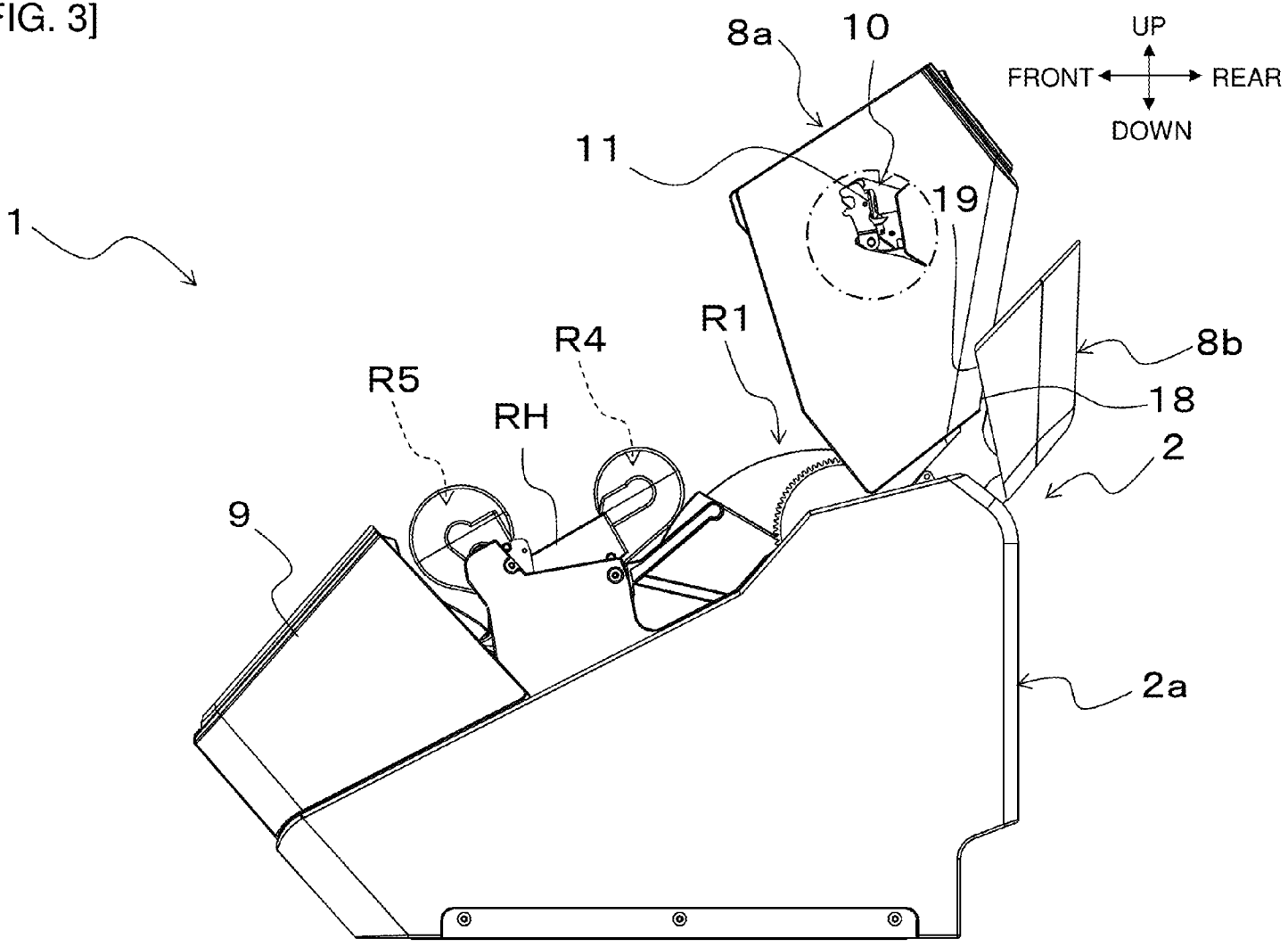
[FIG. 3]

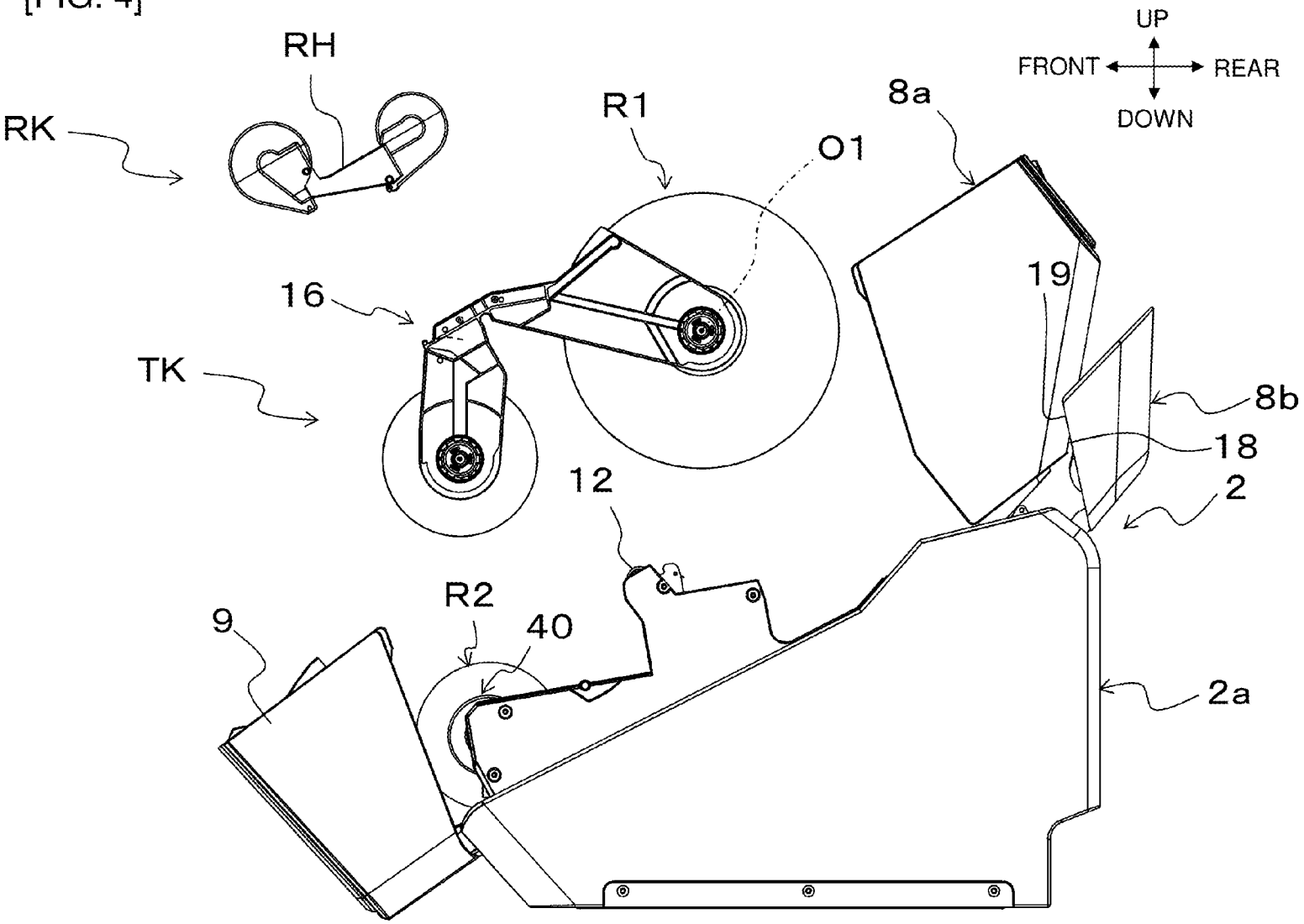
[FIG. 4]

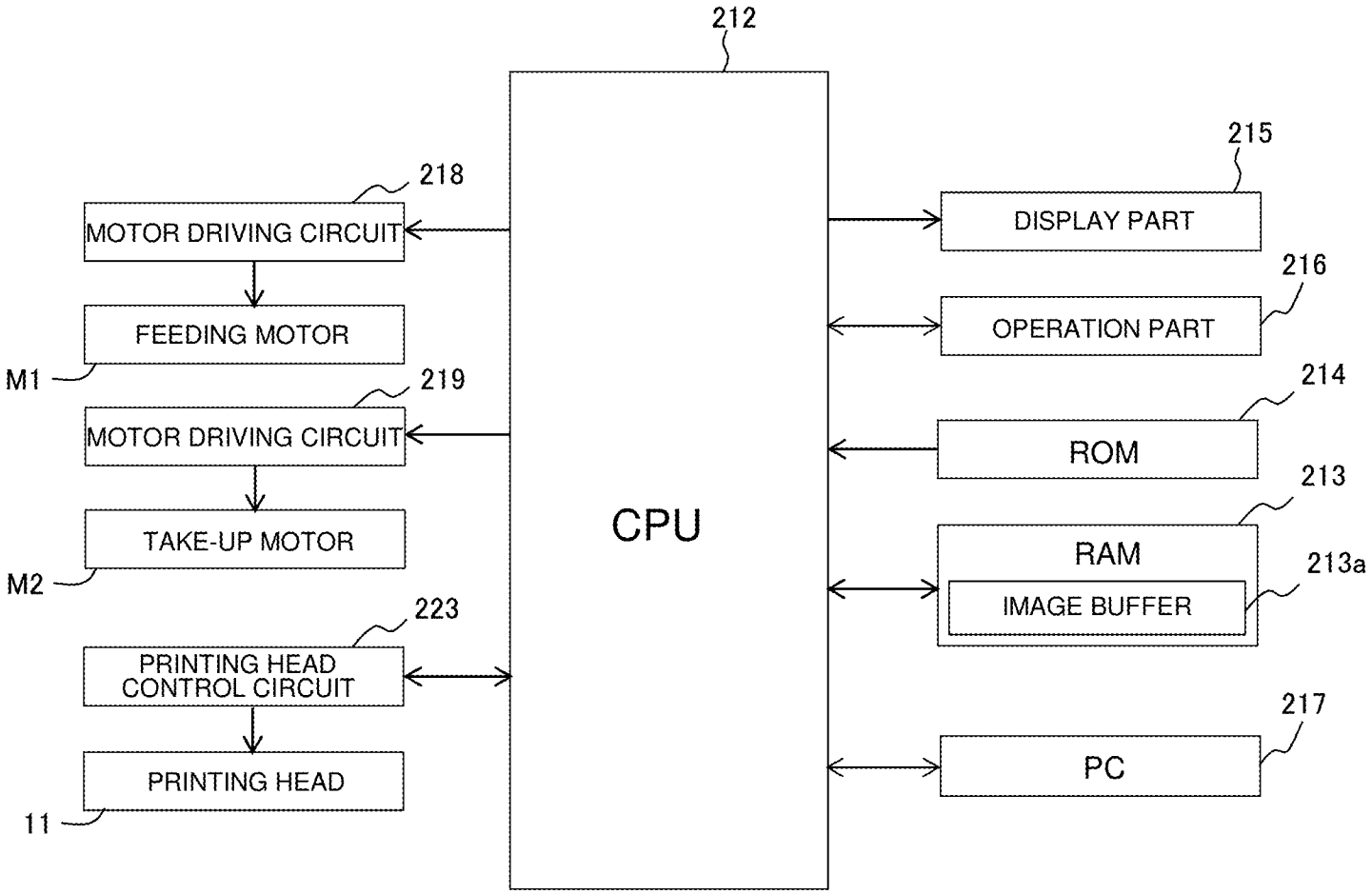
[FIG. 5]

[FIG. 6A]
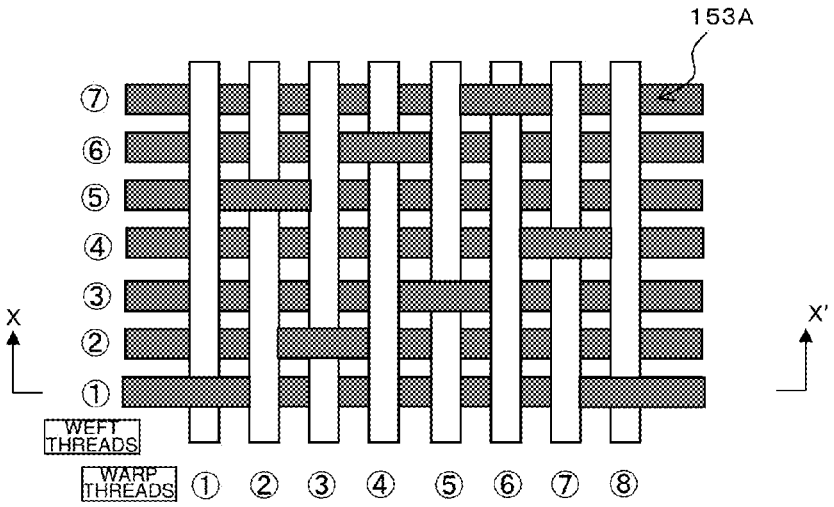
[FIG. 6B]
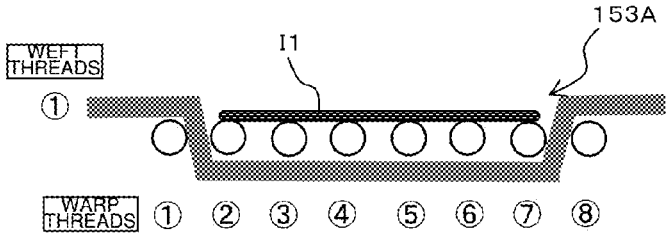
[FIG. 6C]
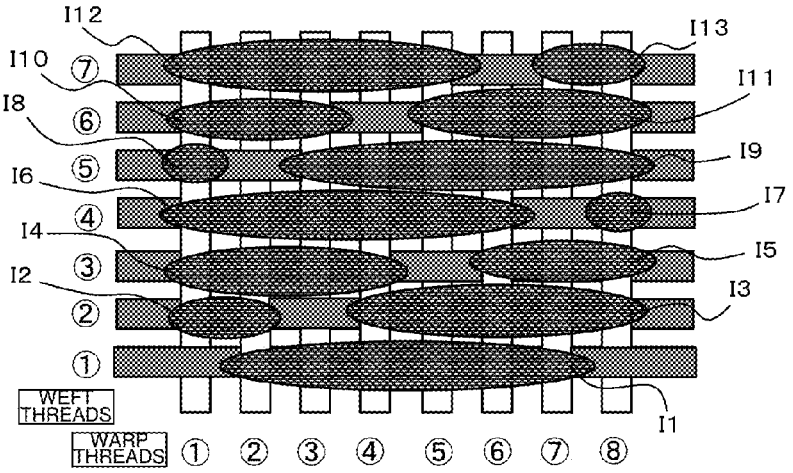

[FIG. 7A]
COMPARISON EXAMPLE
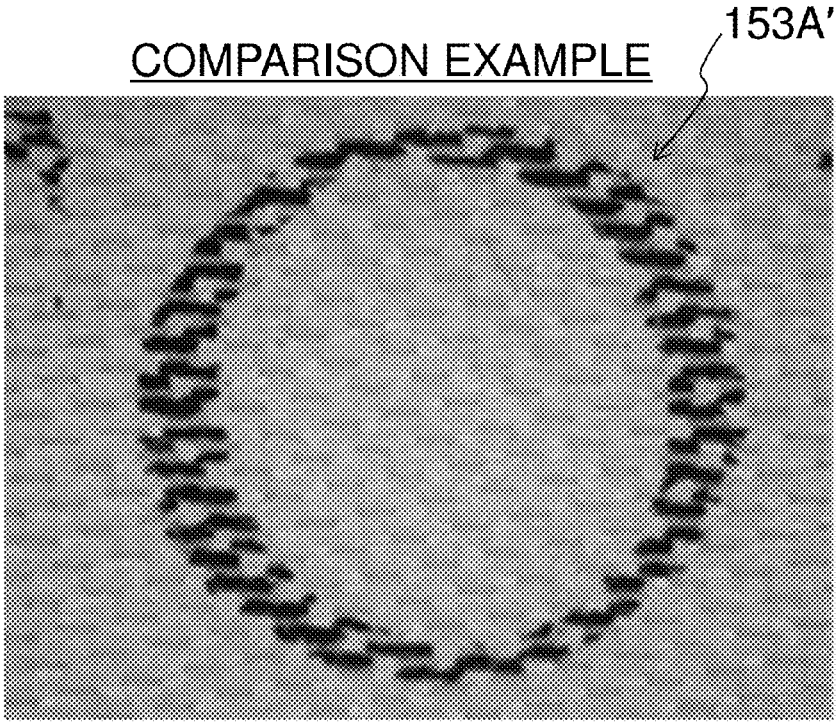
[FIG.7B]
EMBODIMENT
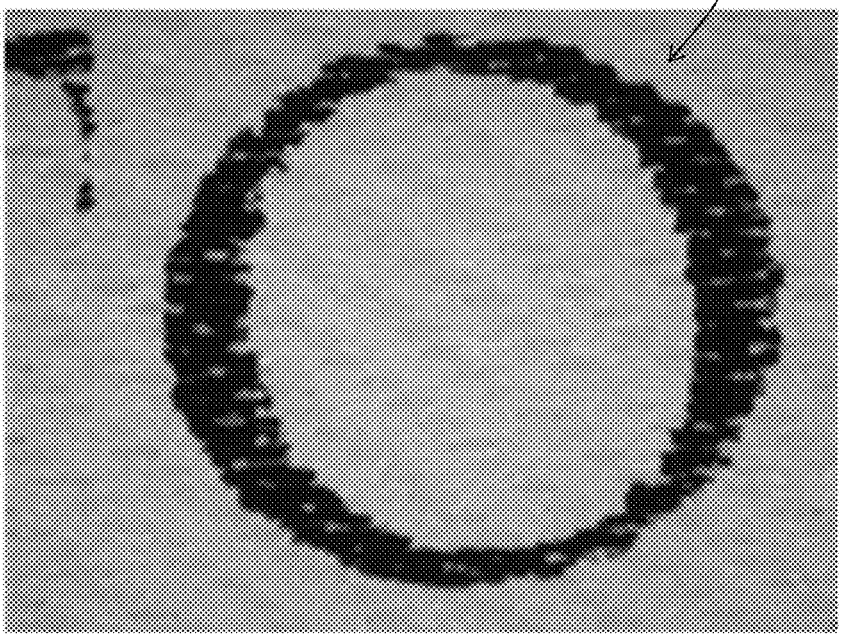

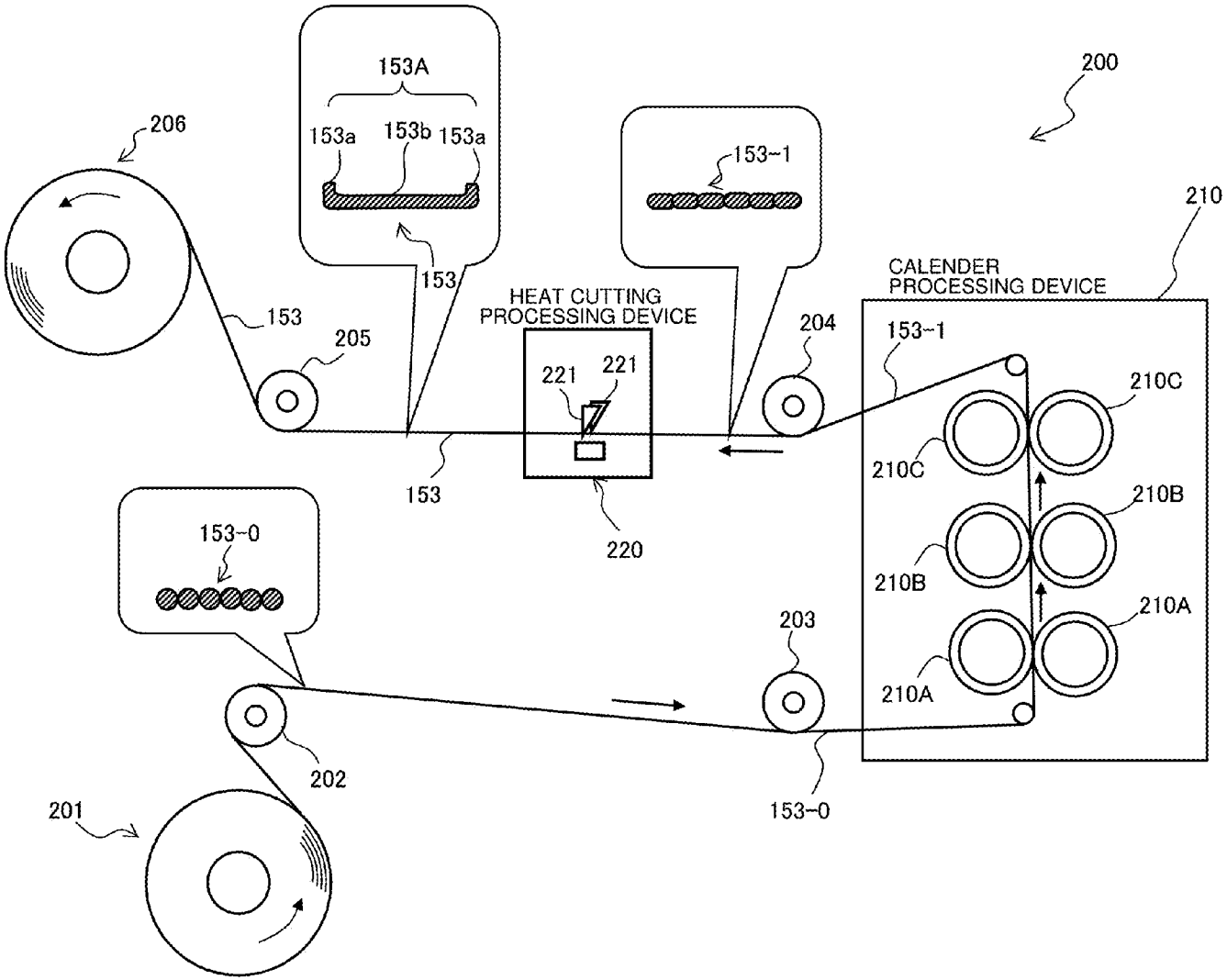
[FIG. 8]

[FIG. 9A]
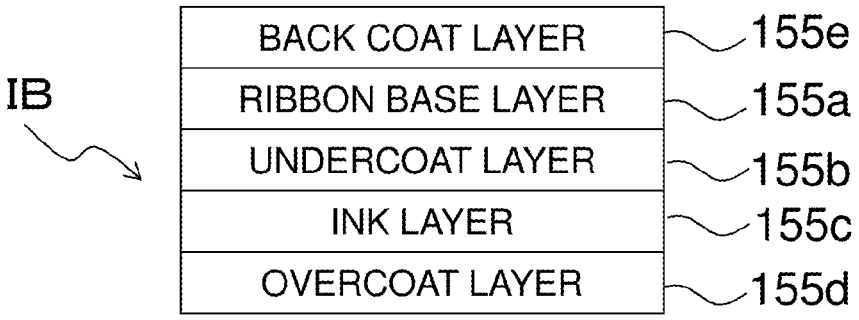
[FIG. 9B]
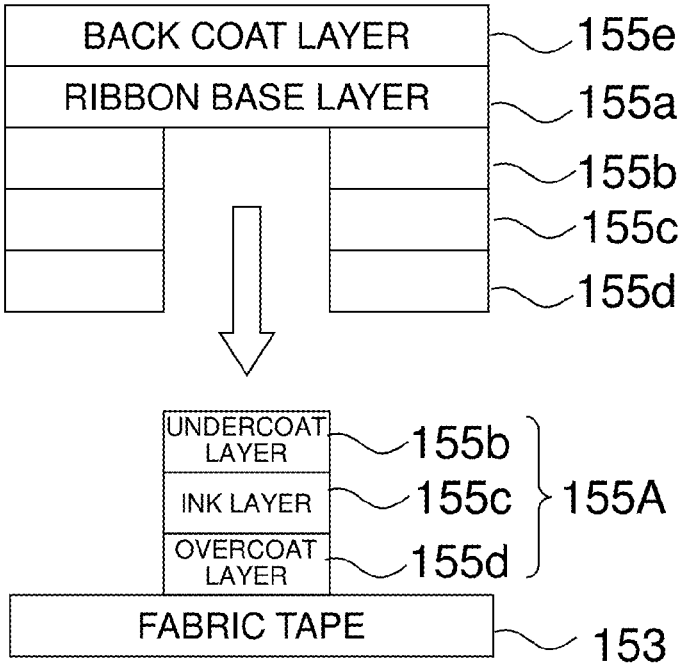

[FIG. 10A]
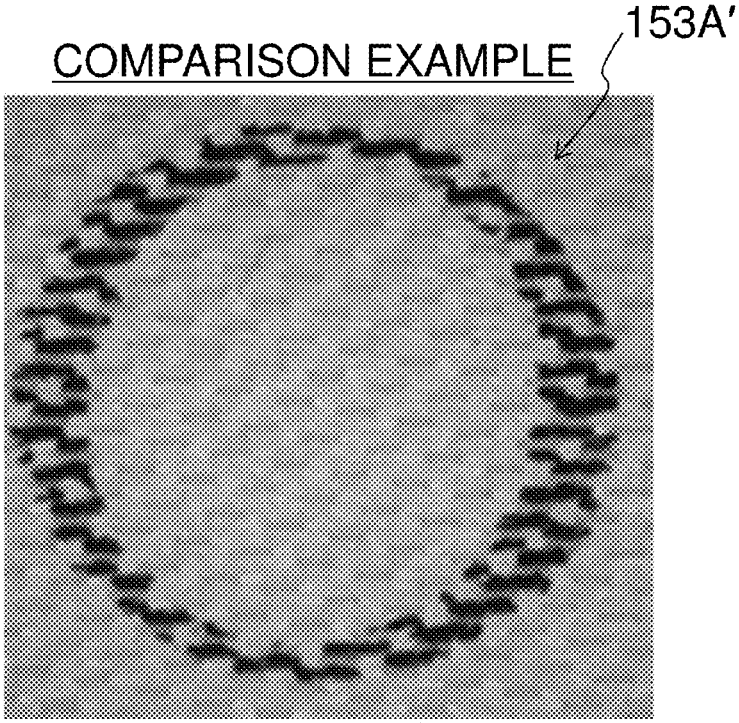
[FIG. 10B]
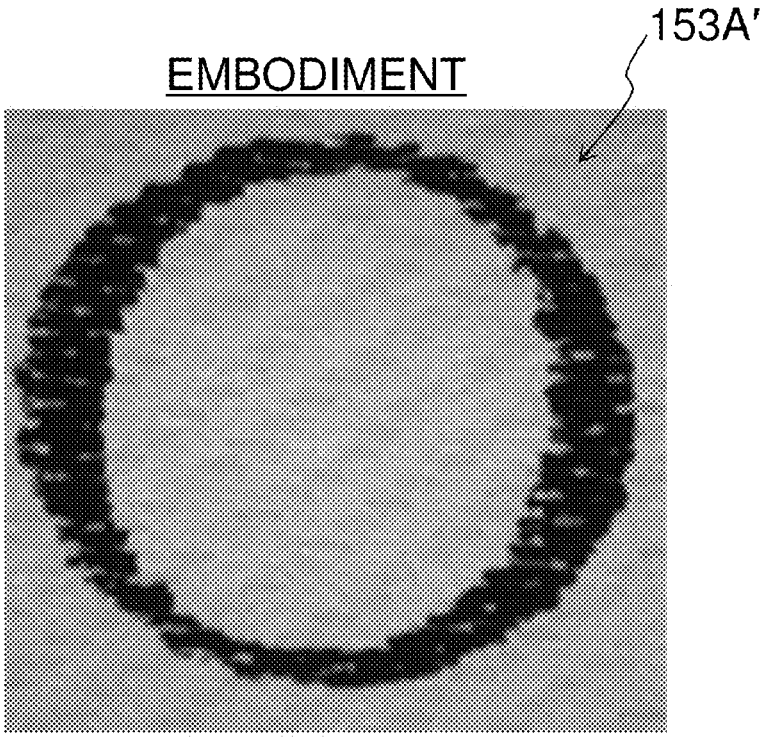

[FIG. 11A]
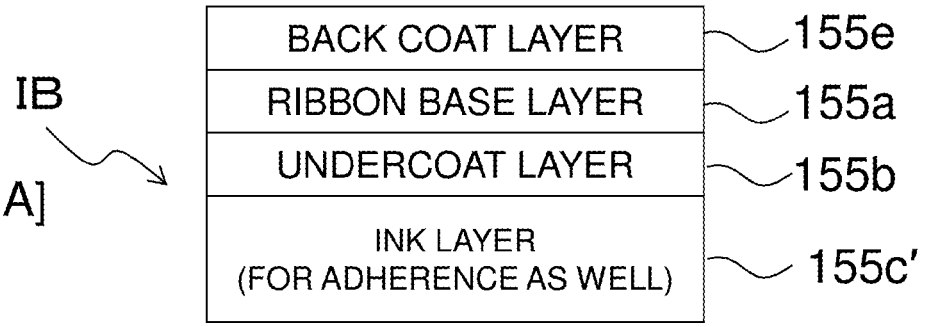
[FIG. 11B]
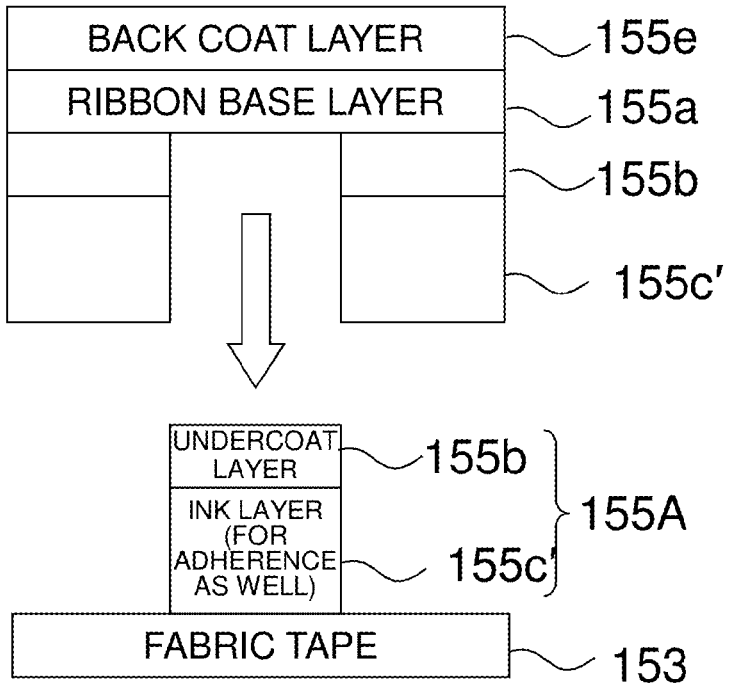

INK RIBBON, RIBBON CARTRIDGE, AND PRINTER

CROSS-REFERENCE TO RELATED APPLICATION

The present application claims priority from Japanese Patent Application No. 2014-242563, which was filed on Nov. 28, 2014, the disclosure of which is incorporated herein by reference in its entirety.

BACKGROUND

Field

The present disclosure relates to an ink ribbon for forming print on a recording medium, a ribbon cartridge comprising the same, and a printer that performs print formation using the ribbon cartridge.

Description of the Related Art

Techniques for printing on a recording medium (fabric tape) by the transfer of an ink of an ink ribbon (dye-containing heat transfer printing ribbon) are already known.

In print techniques that use ink ribbon, an ink melted by received heat adheres to a transfer target, forming print. To improve print quality, the melting point for melting the ink is preferably lowered to speed up melting and transfer. If the melting point is lowered too much, however, the durability of the ink ribbon may decrease during transport and the like under high ambient temperature conditions, for example. In the above prior art, striking such a balance between improving the print quality and suppressing decreases in durability was not particularly taken into consideration.

It is therefore an object of the present disclosure to provide an ink ribbon, a ribbon cartridge, and a printer capable of striking a balance between improving the print quality and suppressing decreases in durability.

SUMMARY

In order to achieve the above-described object, according to the first aspect of the present application, there is provided an ink ribbon, comprising a ribbon base layer, a first layer that is configured to separate from the ribbon base layer and is disposed on a first surface of the ribbon base layer, and a second layer that is configured to adhere to a transfer target and is disposed on the first layer, a melting point of the second layer being 60 [° C.] or more and 90 [° C.] or less.

According to the ink ribbon of the first aspect, the melting point of the second layer that adheres to the transfer target is a relatively low 90° C. or less. With this arrangement, even if not much heat is received, the second layer melts, separates from the ribbon base layer, and quickly adheres to the transfer target, making it possible to improve the print quality. In particular, if high-speed printing is performed, the print quality improvement effect is remarkable. On the other hand, if the melting point is lowered too much, the durability of the ink ribbon may decrease during transport or the like under high ambient temperature conditions. In the present disclosure, the melting point of the second layer is set to 60° C. or more, making it possible to suppress the decreases in durability at high temperatures described above. As a result, it is possible to strike a balance between improving the print quality and suppressing decreases in durability.

In order to achieve the above-described object, according to the second aspect of the present application, there is provided a ribbon cartridge comprising an ink ribbon roll with an ink ribbon wound around an axis, and a support member that rotatably supports the ink ribbon roll, the ink ribbon comprising a ribbon base layer, a first layer that is configured to separate from the ribbon base layer and is disposed on a first surface of the ribbon base layer, and a second layer that is configured to adhere to a transfer target and is disposed on the first layer, a melting point of the second layer being 60 [° C.] or more and 90 [° C.] or less.

In order to achieve the above-described object, according to the third aspect of the present application, there is provided a printer comprising a first storage part configured to store a medium cartridge comprising a recording medium roll with a long recoding medium wound around an axis, and a first support member that rotatably supports the recording medium roll, a second storage part configured to store a ribbon cartridge comprising an ink ribbon roll with an ink ribbon wound around an axis, and a second support member that rotatably supports the ink ribbon roll, a feeder configured to feed the recording medium fed out from the recording medium roll of the medium cartridge, a printing head configured to form desired print by heat transfer printing using the ink ribbon fed out from the ink ribbon roll on the recording medium fed by the feeder to establish a long recorded medium, a winding device configured to sequentially wind the recorded medium generated by the printing head around an outer peripheral area to form a recorded medium roll, and a controller configured to control the feeder and the printing head in coordination, the ink ribbon comprising a ribbon base layer, a first layer that is configured to separate from the ribbon base layer and is disposed on a first surface of the ribbon base layer, and a second layer that is configured to adhere to a transfer target and is disposed on the first layer, a melting point of the second layer being 60 [° C.] or more and 90 [° C.] or less.

BRIEF DESCRIPTION OF THE DRAWINGS

FIG. 1 is a right side view showing the outer appearance of the tape printer related to an embodiment of the present disclosure.

FIG. 2 is a side cross-sectional view showing the internal structure of the tape printer.

FIG. 3 is a right side view showing the outer appearance of the tape printer with the first and the second opening/closing covers open.

FIG. 4 is an exploded side view showing the tape printer with the first and second opening/closing covers open and the tape cartridge and ribbon cartridge removed.

FIG. 5 is a functional block diagram showing the control system of the tape printer.

FIG. 6A is a conceptual top view showing a portion of the print-receiving surface of the fabric tape.

FIG. 6B is a conceptual transverse sectional view taken along a cross-section X-X' in FIG. 6A.

FIG. 6C is an explanatory view showing the adherence behavior of adhered ink drops on the fabric tape.

FIG. 7A is an outer appearance view of the fabric tape showing the print formation results based on a comparison example.

FIG. 7B is an outer appearance view of the fabric tape showing the print formation results based on an embodiment of the present disclosure.

FIG. 8 is an explanatory view showing the manufacturing equipment of the fabric tape.

FIG. 9A is an explanatory view showing the layered structure of the ink ribbon.

FIG. 9B is an explanatory view showing the transfer behavior onto the fabric tape.

FIG. 10A is an outer appearance view of the fabric tape showing the print formation results based on another comparison example.

FIG. 10B is an outer appearance view of the fabric tape showing the print formation results based on an embodiment of the present disclosure.

FIG. 11A is an explanatory view showing the layered structure of the ink ribbon.

FIG. 11B is an explanatory view showing the transfer behavior onto the fabric tape, in a modification in which the ink layer also has an adhering function.

DETAILED DESCRIPTION OF THE PREFERRED EMBODIMENTS

The following describes an embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the printer related to this embodiment will be described with reference to FIGS. 1-4.

In FIGS. 1-4, a tape printer 1 in this embodiment comprises a housing 2 that constitutes the apparatus outer frame, a rearward-side opening/closing part 8, and a frontward-side opening/closing cover 9.

The housing 2 comprises a housing main body 2*a*, a first storage part 3 disposed on the rearward side of the housing main body 2*a*, and a second storage part 4 and a third storage part 5 disposed on the frontward side of the housing main body 2*a*.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 includes a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. A head holding body 10 is disposed in the interior of the first opening/closing cover 8*a* (refer to FIG. 3). Then, the first opening/closing cover 8*a* pivots around the above described pivot axis K1, making it possible to move a printing head 11 (thermal head) disposed in the head holding body 10 relatively closer to or farther away from a feeding roller 12 disposed in the housing main body 2*a*.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*.

Then, the first opening/closing cover 8*a* and the second opening/closing cover 8*b* are configured so that, when each is closed, an outer peripheral part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the second storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1-3) in which it covers the area above the second storage part 4, to an open position (the state in FIG. 4) in which it exposes that area.

At this time, a tape cartridge TK is detachably mounted in a first predetermined position 13 below the frontward-side opening/closing cover 9 (when closed) in the housing main body 2*a*. The tape cartridge TK comprises a first roll R1 formed wound around an axis O1, and a coupling arm 16 (refer to FIG. 4).

The first roll R1 is supported on the rearward side of the tape cartridge TK by the coupling arm 16, and rotatable when the tape cartridge TK is mounted to the housing main body 2*a*. The first roll R1 winds a long fabric tape 153 consumed by feed-out around the axis O1 in the left-right direction in advance. Note that, in each figure of this embodiment, the above described fabric tape 153 disposed as the above described first roll R1 is suitably omitted (to avoid complexities in illustration), and only a substantially circular roll flange part disposed so as to sandwich both width-direction sides of the fabric tape 153 is shown. In this case, as a matter of convenience, the roll flange part is schematically depicted using the reference number "R1."

Then, at this time, the first roll R1 is received from above by the mounting of the tape cartridge TK and stored with the axis O1 of the winding of the fabric tape 153 in the left-right direction in the first storage part 3. Then, the first roll R1, stored in the first storage part 3 (with the tape cartridge TK mounted), rotates in a predetermined rotating direction (a direction A in FIG. 2) inside the first storage part 3, thereby feeding out the fabric tape 153.

A surface on one side (the surface on the upper side in FIG. 2) of the above described fabric tape 153, as shown in the enlarged view in FIG. 2, is a substantially smoothly finished (details described later) print-receiving surface 153A on which print is formed by the above described printing head 11. That is, the tape printer 1 performs desired printing in accordance with print data from a PC 217 (refer to FIG. 5 described later) serving as an operation terminal on the print-receiving surface 153A of the fabric tape 153 by heat transfer printing of an ink of an ink ribbon IB described later using the above described printing head 11. This will be described later.

Further, the above described feeding roller 12 is disposed on an intermediate upward side of the first storage part 3 and the third storage part 5 of the housing main body 2*a*. The feeding roller 12 is driven by a feeding motor M1 disposed in the housing main body 2*a* via a gear mechanism (not shown), thereby feeding the fabric tape 153 fed out from the first roll R1 stored in the first storage part 3 in a tape posture in which the tape width direction is in the left-right direction.

Further, the above described head holding part 10 disposed on the first opening/closing cover 8*a* comprises the above described printing head 11. This printing head 11 is disposed in a position of the head holding part 10 that faces the area above the feeding roller 12, with the first opening/closing cover 8*a* closed, sandwiching the fabric tape 153 fed by the feeding roller 12 in coordination with the feeding roller 12. Accordingly, when the first opening/closing cover 8*a* is closed, the printing head 11 and the feeding roller 12 are disposed facing each other in the up-down direction. The printing head 11 comprises a plurality of heating elements (not shown). An arranged direction of the plurality of heating elements is a direction of weft threads (described later). Then, the printing head 11 forms desired print on the print-receiving surface 153A of the fabric tape 153 sandwiched between the printing head 11 and the feeding roller 12 using an ink ribbon IB of a ribbon cartridge RK described later, and the fabric tape 153 becomes a fabric tape 153' with print.

At this time, the ribbon cartridge RK is detachably mounted in a second predetermined position 14, which is below the first opening/closing cover 8*a* (when closed) and above the tape cartridge TK in the housing main body 2*a*. The ribbon cartridge RK comprises a housing RH (refer to FIG. 3 and FIG. 4), a ribbon supply roll R4, and a ribbon take-up roll R5.

The ribbon supply roll R4 is rotatably supported by the housing RH on the rearward side of the ribbon cartridge RK, and winds the ink ribbon IB (refer to FIG. 9 and the like described later) around a predetermined axis. Then, the ribbon supply roll R4 rotates in a predetermined rotating direction (a direction D in FIG. 2) with the ribbon cartridge RK mounted, thereby feeding out the above described ink ribbon IB for forming print by the printing head 11.

The ribbon take-up roll R5 is rotatably supported by the housing RH on the frontward side of the ribbon cartridge RK, and rotates in a predetermined rotating direction (a direction E in FIG. 2) with the ribbon cartridge RK mounted, thereby taking up the used ink ribbon IB after print formation.

Further, a ribbon take-up roller (not shown) is disposed on the downstream side of the printing head 11 extended along the tape transport direction of the first opening/closing cover 8*a*. The ribbon take-up roller guides the used ink ribbon IB to the ribbon take-up roll R5.

That is, the ink ribbon IB fed out from the ribbon supply roll R4 is disposed further on the printing head 11 side of the fabric tape 153 sandwiched between the printing head 11 and the feeding roller 12, contacting the area below the printing head 11. Then, a portion of the layer (details described later) of the ink ribbon IB is transferred to the print-receiving surface 153A of the fabric tape 153 by the heat from the printing head 11 to execute print formation, and the used ink ribbon IB is subsequently taken up by the ribbon take-up roll R5 while guided by the ribbon take-up roller.

Further, the fabric tape 153' with print after printing is wound on an outer peripheral side of a take-up mechanism 40, thereby forming a second roll R2. That is, the above described take-up mechanism 40 for sequentially winding the fabric tape 153' with print is received from above and stored in the second storage part 4 so that it is supported rotatably around an axis O2, with the axis O2 of the winding of the fabric tape 153' with print in the left-right direction. Then, the take-up mechanism 40, stored in the second storage part 4, is driven by a take-up motor M2 disposed in the housing main body 2*a* via a gear mechanism, and rotates in a predetermined rotating direction (a direction B in FIG. 2) inside the second storage part 4, taking up and layering the fabric tape 153' with print. With this arrangement, the fabric tape 153' with print is sequentially wound on the outer peripheral side of the take-up mechanism 40, forming the above described second roll R2. Note that, in each figure of this embodiment, the above described fabric tape 153' with print disposed on the above described roll R2 is suitably omitted (to avoid complexities in illustration), and only a substantially circular roll flange part disposed so as to sandwich both width-direction sides of the fabric tape 153' with print is shown. In this case, the roll flange part is schematically depicted using the reference number "R2."

Overview of Operation of Tape Printer

Next, an overview of the operation of the tape printer 1 will be described.

That is, when the tape cartridge TK is mounted in the first predetermined position 13, the above described first roll R1 positioned on the rearward side of the tape cartridge TK is stored in the first storage part 3, and the section on the frontward side of the tape cartridge TK is stored in the third storage part 5. Further, the take-up mechanism 40 for forming the second roll R2 is stored in the second storage part 4.

At this time, the feeding roller 12 is driven, feeding the fabric tape 153 fed out by the rotation of the first roll R1 stored in the first storage part 3 to the frontward side. Then, desired print is formed on the print-receiving surface 153A of the fed fabric tape 153 by the printing head 11, and the fabric tape 153 becomes the fabric tape 153' with print. The fabric tape 153' with print is further fed to the frontward side, introduced to the second storage part 4, and wound on the outer peripheral side of the take-up mechanism 40 inside the second storage part 4, thereby forming the second roll R2. At this time, a cutter mechanism 30 disposed further on the rearward side than the second roll R2, that is, on the frontward side opening/closing cover 9 on the upstream side of the second roll R2 extended along the tape transport direction, cuts the fabric tape 153' with print. With this arrangement, it is possible to cut the fabric tape 153' with print to be wound in the second roll R2, and remove the second roll R2 from the second storage part 4 after cutting, based on timing desired by the user.

Note that, a shoot 15 for switching the feeding path of the above described fabric tape 153' with print between a side facing the second roll R2 and a side facing a discharging exit (not shown) may be arranged. That is, the fabric tape 153' with print may be discharged as is from a discharging exit (not shown) disposed on the second opening/closing cover 8*b* side, for example, of the housing 2 to the outside of the housing 2 (without being wound inside the second storage part 4) by switching the tape path in a switch operation of the shoot 15 using a switch lever (not shown).

Control System

Next, the control system of the tape printer 1 will be described. In FIG. 5, the tape printer 1 comprises a CPU 212. The CPU 212 is connected to a RAM 213, a ROM 214, a display part 215, and an operation part 216. The CPU 212 performs signal processing in accordance with a program stored in advance in the ROM 214 while utilizing a temporary storage function of the RAM 213, thereby controlling the entire tape printer 1. Further, the CPU 212 is connected to a motor driving circuit 218 that controls the driving of the above described feeding motor M1 that drives the above described feeding roller 12, a motor driving circuit 219 that controls the driving of the above described take-up motor M2 that drives the above described second roll R2, and a printing head control circuit 223 that controls the conduction of the heating elements of the above described printing head 11.

The RAM 213 comprises an image buffer 213*a* that expands print data of an image data format received from the PC 217 (or generated in accordance with an operation of the operation part 216) into dot pattern data for printing on the above described fabric tape 153, and stores the dot pattern data. The CPU 212 performs printing corresponding to the print data on the above described print-receiving surface 153A by the printing head 11 via the printing head control circuit 223 in accordance with the above described print data stored in the image buffer 213*a* while feeding out the fabric tape 153 by the feeding roller 12, according to a suitable control program stored in the ROM 214. Note that, according to this embodiment, the feeding roller 12 and the printing head 11 are synchronized with each other and controlled in coordination by a known technique so that the printing speed for the fabric tape 153 becomes 100 [mm/sec] or higher and 200 [mm/sec] or lower by the control of the CPU 212.

Special characteristic of the embodiment In the above, according to the tape printer 1, desired printing corresponding to the above described print data is performed on the print-receiving surface 153A of the fabric tape 153 by heat transfer printing of the ink of the ink ribbon IB using the above described printing head 11, as described above. The special characteristics of this embodiment lie in the configuration of the fabric tape 153 and the ink ribbon IB for preventing inconveniences resulting from an uneven shape of the above described fabric tape 153 and ensuring high print quality during the above described printing. In the following, details on the functions will be described in order.

Unevenness of Fabric Tape

A fabric medium such as the above described fabric tape 153 is generally configured by weaving warp threads (extending along the tape longitudinal direction) and weft threads (extending along the tape width direction) and, as a result, unevenness from the weave exists on the front surface. This unevenness hinders smooth print formation by heat transfer printing using the aforementioned ink ribbon IB when large. Accordingly, to ensure high print quality, some measure is required. In particular, if high-speed printing is to be performed, a sufficient countermeasure is required since it is not possible to take a sufficient amount of time for the melting and transfer of the ink of the ink ribbon IB.

Satin Weave

As a result of repeated independent studies, the inventors and the like of this application discovered that it is possible to decrease the unevenness of the print-receiving surface 153A by making the fabric tape 153 a satin weave with more warp thread exposure on the front surface, and establishing a medium front surface on one or the other thickness-direction side of the fabric tape 153, whichever has more warp thread exposure than weft thread exposure, as the above described print-receiving surface 153A. FIG. 6A and FIG. 6B show conceptual views indicating the details of the above described satin weave of the fabric tape 153A in this embodiment. FIG. 6A is a conceptual top view showing a portion of the print-receiving surface 153A, and FIG. 6B is a conceptual transverse sectional view taken along a cross-section X-X' in FIG. 6A.

As shown in FIG. 6A and FIG. 6B, the fabric tape 153 in this embodiment is a satin weave of a so-called 7-end satin. The area of the above described print-receiving surface 153A shown in FIG. 6A, for example, is a weave configuration in which eight warp threads (1)-(8) and seven weft threads (1)-(7) cross each other.

In this example, the warp thread (1) is woven on the back side (the side opposite the print-receiving surface 153A; hereinafter the same) at an intersecting location with the weft thread (1), but is woven so as to be exposed on the front side (the print-receiving surface 153A side; hereinafter the same) at intersecting locations with the remaining weft threads (2)-(7). Similarly, the warp thread (2) is woven on the back side at an intersecting location with the weft thread (5), but is woven so as to be exposed on the front side at intersecting locations with the remaining weft threads (1)-(4) and (6)-(7). Further, the warp thread (3) is woven on the back side at an intersecting location with the weft thread (2), but is woven so as to be exposed on the front side at intersecting locations with the remaining weft threads (1) and (3)-(7). Further, the warp thread (4) is woven on the back side at an intersecting location with the weft thread (6), but is woven so as to be exposed on the front side at intersecting locations with the remaining weft threads (1)-(5) and (7). Further, the warp thread (5) is woven on the back side at an intersecting location with the weft thread (3), but is woven so as to be exposed on the front side at intersecting locations with the remaining weft threads (1)-(2) and (4)-(7). Further, the warp thread (6) is woven on the back side at an intersecting location with the weft thread (7), but is woven so as to be exposed on the front side at intersecting locations with the remaining weft threads (1)-(6). Further, the warp thread (7) is woven on the back side at an intersecting location with the weft thread (4), but is woven so as to be exposed on the front side at intersecting locations with the remaining weft threads (1)-(3) and (5)-(7). Further, the warp thread (8) is woven on the back side at an intersecting location with the weft thread (1), but is woven so as to be exposed on the front side at intersecting locations with the remaining weft threads (2)-(7). According to this embodiment, as a result of a weave configuration such as described above, it is possible to relatively decrease the unevenness of the print-receiving surface 153A of the fabric tape 153.

Weaving Density of Warp and Weft Threads

Further, as a result of repeated simultaneous studies, the inventors and the like of this application discovered that it is possible to increase the number of warp threads to reliably increase exposure by relatively increasing the weaving density (300 [threads/inch] or more, for example) of the warp threads in the above described fabric tape 153. In particular, the inventors and the like discovered that (the number of warp and weft intersecting points can be decreased and therefore) the weaving density of the warp threads can be reliably increased by establishing at least a six-end satin in the above described satin weave. With the resulting increase in warp thread exposure, in the area of the print-receiving surface 153A shown in the above described FIG. 6A and FIG. 6B, for example, it is possible to adhere a great number of ink drops (that includes a transfer layer 155A made of an undercoat layer 155*b*, an ink layer 155*c*, and an overcoat layer 155*d* described later) I1-I13 from the ink ribbon IB in a wide range in areas where a great number is exposed, as shown in FIG. 6C. Note that, during manufacture using a weaving machine, a fabric medium such as the above described fabric tape 153 normally requires the weaving machine to finely divide and vertically move the warp threads in accordance with the number of satin ends. As a result of independent studies regarding this point as well, the inventors and the like of this application discovered that it is possible to keep the weave from becoming too complicated and reliably manufacture the fabric medium by a weaving machine by configuring the fabric tape 153 as a 10-end satin or less.

Further, while the warp threads may become too fine, causing decreases in durability and the occurrence of slippage in the satin weave, if the weaving density of the warp threads is made too high, the inventors and the like of this application, as a result of independent studies, discovered that it is possible to prevent the above described adverse effect by setting the weaving density of the warp threads to 540 [threads/inch] or less, for example. Note that, according to the fabric tape 153 in this embodiment, the range of the weaving density of the weft threads is set to 80 [threads/inch] or more and 540 [threads/inch] or less in order to match the aforementioned range of the weaving density of the warp threads to 300 [threads/inch] or more and 540 [threads/inch] or less, and perform smooth weaving.

Low Print Quality Based on Comparison Example

The inventors and the like of this application fabricated the fabric tape 153 based on a 5-end satin weave as a comparison example to confirm the study results described above. At this time, the weaving density of the warp threads was set to less than 300 [threads/inch], and the weaving density of the weft threads was set to less than 80 [threads/inch]. Then, the inventors and the like fabricated the fabric tape 153' with print by performing so-called high-speed printing that is a printing speed of 100 [mm/sec] on the fabric tape 153 in this comparison example, in the tape printer 1 with the above described configuration. The print formation results are shown in FIG. 7A. In FIG. 7A, while print formation of the upper-case character "O" was performed in this example, the number of satin ends was small and the weaving density of the warp threads was low as described above, resulting in not much warp thread exposure. With this arrangement, the unevenness of the print-receiving surface 153A' was relatively large, causing a large number of faint print areas to occur in the character "O," and resulting in low print quality.

High Print Quality by Manufacturing Conditions in Line with Study Results

In response to the above described comparison example, the inventors and the like of this application fabricated the above described fabric tape 153 based on a satin weave of 6-end satin or more and 10-end satin or less (7-end satin, for example), in line with the above described study results. At this time, the weaving density of the warp threads was set to 300 [threads/inch] or more and 540 [threads/inch] or less (360 [threads/inch], for example) and the weaving density of the weft threads was set to 80 [threads/inch] or more and 540 [threads/inch] or less (106 [threads/inch], for example). Then, the inventors and the like fabricated the fabric tape 153' with print by performing high-speed printing that is a printing speed of 100 [mm/sec] in the same way as the above described comparison example on the fabric tape 153, in the tape printer 1 with the above described configuration. The print formation results are shown in FIG. 7B. As shown in FIG. 7B, in this example, the number of satin ends was more than that in the above described comparison example and the weaving density of the warp threads was high, sufficiently increasing the warp thread exposure. With this arrangement, the unevenness of the print-receiving surface 153A' was relatively small, resulting in high print quality with an extremely small number of faint print areas in the character "O."

Calender Processing

Further, according to the above described fabric tape 153 in this embodiment, known calender processing is performed on the print-receiving surface 153A side in order to improve the above described print quality. The following describes the details using FIG. 8.

FIG. 8 shows the conceptual configuration of the manufacturing equipment of the above described fabric tape 153. In manufacturing equipment 200 shown in FIG. 8, a raw fabric 153-0 prior to calender processing is wound in a supply roll 201. Note that, in this embodiment, the warp and weft threads disposed in the raw fabric 153-0 are both made of polyester, for example. The raw fabric 153-0 fed out from this supply roll 201 is introduced to a calender processing device 210 via guide rolls 202, 203.

The calender processing device 210, in this example, comprises heatable rotating drums 210A, 210A, rotating drums 210B, 210B, and rotating drums 210C, 210C. Then, the introduced above described raw fabric 153-0 is heated and pressed by the respective pairs of rotating drums 210A, 210B, 210C while fed at a predetermined speed. With this arrangement, the above described raw fabric 153-0 becomes a shiny fabric 153-1 wherein at least the side that becomes the print-receiving surface A (both sides in this example) is smoothened and given a lustrous shine (refer to the enlarged view). Note that this calender processing is performed under the conditions of a heating temperature of 160 [° C.] or more, the above described feeding speed of 10 [m/min] or lower, and a pressure of the above described pressing of 7 [MPa] or more, for example.

The shiny fabric 153-1 derived from the calender process device 210 is supplied to a heat cutting processing device 220 via a guide roll 204. The heat cutting processing device 220 comprises heatable cutter parts 221, 221 on both width-direction sides of the feeding path of the shiny fabric 153-1. According to this embodiment, the raw fabric 153-0 (that is, the shiny fabric 153-1) includes a hot melt fiber, and both width-direction ends of the shiny fabric 153-1 are cut (heat cutting processing) by the above described cutter parts 221, 221, thereby becoming the above described fabric tape 153. Note that the heating conditions of the above described cutter part 221 is 525 [° C.], for example. As a result of this processing, the print-receiving surface 153A of the fabric tape 153 comprises relatively thick ear parts 153*a*, 153*a* positioned on edges of both width-direction sides, and print area 153*b* on which print is formed by the aforementioned printing head 11, positioned between these ear parts 153*a*, 153*a* in a width-direction intermediate area. Note that each figure other than this FIG. 8 omits the ear part 153*a* to avoid complexities in illustration.

The fabric tape 153 thus formed is wound inside an original winding roll 206 via a guide roll 205. Note that, as a result of the above processing, the thickness of above described warp threads and the thickness of the weft threads of the fabric tape 153 become 30 [deniers] or more and 90 [deniers] or less (specifically, 48 [deniers], for example), and 30 [deniers] or more and 90 [deniers] or less (specifically, 75 [deniers], for example), respectively. Further, the above described first roll R1 need only use the above described original winding roll 206 as is or a roll with the fabric tape 153 fed out once again from the original winding roll 206 wound around a suitable winding core (so that the print-receiving surface 153A is on the outer peripheral side).

Ink Ribbon

On the other hand, print that utilizes the heat transfer printing of ink in the same way as the above described ink ribbon IK is formed by the adherence of ink drops, which melted due to received heat, to the transfer target. To improve the print quality, the melting point for melting the ink ribbon is preferably lowered to speed up melting and transfer. If the melting point is lowered too much, however, the durability of the ink ribbon may decrease during transport and the like under high ambient temperature conditions, for example. Thus, to strike a balance between improving the print quality and suppressing decreases in durability, some measure is required in relation to the layer structure of the ink ribbon, the physical properties of each layer, and the like.

Details of Layered Structure of Ink Ribbon

As a result of independent studies, the inventors and the like of this application discovered that, in the layered structure of the ink ribbon IB, it is possible to strike the above described balance between improving the print quality and decreasing the durability by setting the melting point of the layer to be adhered to the fabric tape 153 in a predetermined range (described later). FIG. 9A shows a conceptual view indicating the details of the layered structure of the ink ribbon IB in this embodiment.

As shown in FIG. 9A, the ink ribbon IB is a layered structure with five layers in this example, comprising a ribbon base layer 155*a* made of a PET film or the like as the ribbon base layer; the undercoat layer 155*b* that melts by predetermined heat reception and separates from the ribbon base layer 155*a*, disposed adjacent to a first side (lower side in the figure) of this ribbon base layer 155*a* in the thickness direction; the ink layer 155*c* that includes a pigment, for example, and gives visual color for printing, disposed adjacent to the above described first side of the undercoat layer 155*b* in the above described thickness direction (that is, positioned between the overcoat layer 155*d* and the undercoat layer 155*b* described later in a thickness-direction intermediate area); the overcoat layer 155*d* that adheres to the transfer target, disposed adjacent to the above described first side of the ink layer 155*c* in the above described thickness direction; and a back coat layer 155*e* that plays the role as a heat-resistant coat, disposed adjacent to a second side (upper side in the figure) of the ribbon base layer 155*a* in the above described thickness direction.

Films that may be used for the ribbon base layer 155*a* include, for example, polyester films such as polyethylene naphthalate film (PEN), polyarylate film (PAR), and polybutylene terephthalate film (PBT) in addition to the above described polyethylene terephthalate film (PET), and various other films generally used as a base film of ink ribbon.

The undercoat layer 155*b* and the overcoat layer 155*a* include a resin component and a wax component, and the ink layer 155*c* includes a resin component, a pigment component, and a wax component (details described later).

In the ink ribbon IB with the above described configuration, the above described undercoat layer 155*b* is melted by heat reception resulting from the heat from the printing head 11, thereby separating the transfer layer 155A made of the undercoat layer 155*b*, the ink layer 155*c*, and the overcoat layer 155*d* from the above described ribbon base layer 155*a*. Then, the overcoat layer 155*d* side of the transfer layer 155A is transferred and adheres to the print-receiving surface 153A of the fabric tape 153 serving as the transfer target (refer to FIG. 9B). With this arrangement, print formation is executed on the print-receiving surface 153A of the fabric tape 153 by the ink ribbon IB, generating the above described fabric tape 153' with print.

Setting the Melting Point

As a result of repeated studies, the inventors and the like of this application discovered that it is possible to strike the above described balance between improving the print quality and decreasing the durability by setting the melting point of the above described overcoat layer 155*a* to 60° C. or more and 90° C. or less. That is, the melting point of the overcoat layer 155*a* is set to a relatively low 90° C. or less, thereby causing the layer to melt, separate from the ribbon base layer 155*a*, and quickly adhere to the fabric tape 153 serving as the transfer target, even if there is not much heat reception. As a result, it is possible to improve the print quality. In particular, if high-speed printing that is 100 [mm/sec] or higher is performed, for example, the above described print quality improvement effect is remarkable, as described above. On the other hand, if the melting point is lowered too much, the durability of the overall ink ribbon IB may decrease during transport or the like under high ambient temperature conditions. In this embodiment, the melting point of the overcoat layer 155*a* is set to 60° C. or more, making it possible to suppress the above described decreases in durability at high temperatures. As a result, it is possible to strike a balance between improving the print quality and suppressing decreases in durability.

Low Print Quality Based on Comparison Example

The inventors and the like of this application fabricated the fabric tape 153' with print by performing so-called high-speed printing that is a printing speed of 100 [mm/sec] on the above described fabric tape 153 by the tape printer 1 with the above described configuration, using the ink ribbon IB with a melting point of the above described overcoat layer 155*a* set to less than 90° C., as a comparison example for confirming the study results described above. The print formation results are shown in FIG. 10A. In FIG. 10A, while print formation of the upper-case character "O" was performed in this example, the melting point of the overcoat layer 155*a* was low as described above, causing failure to perform the adherence by melting and transfer quickly (failure to complete the process in time since the melting and transfer speed was not sufficiently fast with respect to the feeding speed). With this arrangement, a large number of faint print areas occurred in the character "O" on the print-receiving surface 153A', resulting in low print quality.

High Print Quality by Manufacturing Conditions in Line with Study Results

In response to the above described comparison example, the inventors and the like of this application fabricated the fabric tape 153' with print by performing high-speed printing that is a printing speed of 100 [mm/sec] in the same way as the above described comparison example on the above described fabric tape 153 by the tape printer 1 with the above described configuration, using the ink ribbon IB comprising the overcoat layer 155*a* having a melting point of 60° C. or more and 90° C. or less (80° C., for example), in line with the above described study results. The print formation results are shown in FIG. 10B. As shown in FIG. 10B, in this example, the melting point of the overcoat layer 155*a* was lower than that in the above described comparison example, causing the adherence by melting and transfer to be performed quickly (the melting and transfer speed to be sufficiently fast with respect to the feeding speed). With this arrangement, the number of faint print areas in the character "O" on the print-receiving surface 153A' was extremely small, resulting in high print quality.

Note that, in the ink ribbon IB with the above described configuration, according to this embodiment, the resin to wax component ratio (weight ratio) in the overcoat layer 155*a* is resin:wax=5:5, for example. Further, the resin to wax component ratio (weight ratio) in the undercoat layer 155*b* is resin:wax=1:9, for example, and the melting point of the overall undercoat layer 155*b* is approximately 95° C., for example, as a result. Further, the resin to pigment to wax component ratio (weight ratio) in the ink layer 155*c* is resin:pigment:wax=4:5:1, for example, and the melting point of the overall ink layer 155*c* is approximately 85° C., for example, as a result. Note that, as a result of further studies on the weight ratio of the wax component in relation to the overcoat layer 155*a*, the inventors and the like of this application discovered that it is possible to reliably improve the adherence to the transfer target by setting the weight ratio of the wax component to 50 [%] or more. Further, the inventors and the like discovered that it is possible to suppress decreases in abrasion resistance by setting the weight ratio of the wax component to 70 [%] or less.

Note that the above described wax component used in the above described undercoat layer 155*b*, overcoat layer 155*a*, and ink layer 155*c* need only be, for example, one type (or two or more types mixed together) from among natural waxes, such as beeswax (animal wax), carnauba wax, candelilla wax, Japan wax, rice wax (vegetable wax), montan wax, ozocerite wax, and ceresin wax (mineral wax); petroleum waxes such as paraffin wax and microcrystalline wax; and synthetic waxes such as Fischer-Tropsch wax, polyethylene wax (hydrocarbon synthetic wax), higher fatty acid ester, fatty acid amide, ketone, amines, and hydrogen hardened oil.

Further, the above described resin (hot melt resin) component used in the above described undercoat layer 155*b*, overcoat layer 155*a*, and ink layer 155*c* need only be, for example, one type (or two or more types mixed together) from among olefinic-based copolymer resins such as ethylene-vinyl acetate copolymer and ethylene-acrylate copolymer; elastomers such as polyamide resin, polyester resin, epoxy resin, polyurethane reins, acrylic resin, vinyl chloride resin, cellulose resin, vinyl alcohol resin, petroleum resin, phenolic resin, styrene resin, vinyl acetate resin, natural rubber, styrene-butadiene rubber, isoprene rubber, and chloroprene resin; polyisobutylene; and polybutene.

Advantages of this Embodiment

As described above, in this embodiment, the fabric tape 153 is made into a satin weave with more warp thread exposure on the front surface, and the side with more warp thread exposure is established as the print-receiving surface 153A, making it possible to decrease the unevenness of the print-receiving surface 153A. In particular, the weaving density of the warp threads is set to 300 [threads/inch] or more, making it possible to increase the number of warp threads and reliably increase exposure. In particular, the satin is established as at least a 6-end satin, making it possible to decrease the number of warp and weft intersecting points and reliably increase the weaving density of the warp threads. Further, calender processing is performed on the above described print-receiving surface 153A, making it possible to give a lustrous shine to the front surface of the print-receiving surface 153A. As a result, it is possible to achieve the print-receiving surface 153A with small unevenness, high warp thread exposure, and lustrous shine, making it possible to improve the print quality when forming print by the transfer of ink drops (the above described transfer layer 155A in this example) using the above described ink ribbon IB. In particular, the quality improvement effect is significant when high-speed printing that is 100 [mm/sec] or higher is executed, for example.

Further, in particular, according to this embodiment, the thickness of the warp thread of the fabric tape 153 is set to 30 [deniers] or more, making it possible to reliably suppress decreases in durability and the occurrence of slippage in the satin weave caused by the warp thread becoming too fine. Further, the thickness of the warp threads is set to 90 [deniers] or less, making it possible to reliably suppress decreases in print quality caused by a decrease in weaving density and loose weaves. Then, in correspondence with the above described thickness range of the warp threads, the thickness of the weft threads is set to 30 [deniers] or more and 90 [deniers] or less, making it possible to obtain the fabric tape 153 that is appropriately combined with warp threads that achieve the advantage described above.

Further, in particular, according to this embodiment, both width-direction sides of the fabric tape 153 are subjected to heat cutting processing. With this arrangement, it is possible to suppress the occurrence of fray on the edges of both sides.

Further, in particular, according to this embodiment, it is possible to strikingly achieve the above described print quality effect in particular during high-speed printing that is a printing speed of 100 [mm/sec] or higher, as described above. At this time, the upper limit of the printing speed is suppressed to 200 [mm/sec] or lower, making it possible to ensure favorable meltability and favorable adherence to the transfer target of the ink drops (the above described transfer layer 155A in this example) of the ink ribbon IB, and reliably improve the print quality.

Note that, while the weaving density of the warp threads is set to 300 [threads/inch] or more from the viewpoint of increasing warp thread exposure and decreasing unevenness in the above, the weaving density may be determined taking into account the resolution of the printing head 11 as well (the fabric tape 153 with a weaving density greater than or equal to the resolution of the printing head 11). That is, for example, if the value of the weaving density of the fabric tape 153 is lower (less than 300 [threads/inch]; approximately 200 [threads/inch], for example) than the resolution of the printing head 11 when the resolution is relatively high (300 dpi, for example), adherence of the ink drops generated at the fine resolution is hindered by the unevenness of the loose weaving density, making adherence and thus dot formation impossible. Accordingly, if the resolution of the printing head 11 is set to approximately 300 dpi, for example, as described above, it is best to set the weaving density of the fabric tape 153 to a value that is at least equivalent to the resolution or to 300 [threads/inch] or more, which is higher than the resolution, preferably to approximately 360 [threads/inch], which is approximately 20% higher. With this arrangement, it is possible to reliably achieve high print quality.

Further, as described above, in this embodiment, the melting point of the overcoat layer 155*a* included in the ink ribbon IB is set to 60° C. or more and 90° C. or less, making it possible to strike a balance between improving the print quality and suppressing decreases in durability.

Further, in particular, according to this embodiment, the weight ratio of the wax component included in the overcoat layer 155*a* of the ink ribbon IB is set to 50 [%] or more and 70 [%] or less (50% in the aforementioned example), making it possible to reliably improve the adherence to the transfer target and suppress decreases in abrasion resistance, thereby reliably maintaining the integrity of the ink ribbon.

Further, in particular, according to this embodiment, both width-direction sides of the fabric tape 153 become the ear parts 153*a* subjected to heat cutting processing, making it possible to suppress the occurrence of fray on the edges of both sides. Further, print formation is avoided on the ear parts 153*a* with a larger thickness and performed in the print area 153*b* with a smaller thickness, thereby making it possible to reliably suppress the occurrence of faint print and the like.

Note that the present disclosure is not limited to the above aspects, and various modifications may be further made without deviating from the spirit and scope of the disclosure. The following describes various modifications that satisfy such conditions, one by one. Note that components identical to those in the above described embodiment are denoted using the same reference numbers, and descriptions thereof will be omitted or simplified as appropriate.

(1) When the Ink Layer of the Ink Ribbon Also Serves as the Adhering Function

FIG. 11A shows a conceptual view indicating the details of the layered structure of the ink ribbon IB in this modification. As shown in FIG. 11A, in this modification, the layered structure is four layers wherein an ink layer 155*c'* with an adhering function is disposed in place of the ink layer 155*c* and the overcoat layer 155*d* in the layered structure shown in FIG. 9A of the above described embodiment, the ink layer 155*c'* having the characteristics of these two layers. This ink layer 155*c'* includes a pigment that gives visual color for printing, and comprises a function for adhering to the transfer target as well. The ink layer 155*c*', similar to the above described ink layer 155*c*, includes a resin component, pigment component, and wax component.

In the ink ribbon IB with the above described configuration, the above described undercoat layer 155*b* is melted by heat reception resulting from the heat from the printing head 11, thereby separating the transfer layer 155A of this modification that is made of the undercoat layer 155*b* and the ink layer 155*c'* from the above described ribbon base layer 155*a*. Then, the transfer layer 155A is transferred and adheres to the print-receiving surface 153A of the fabric tape 153 serving as the transfer target (refer to FIG. 11B). With this arrangement, print formation is executed on the print-receiving surface 153A of the fabric tape 153 by the ink ribbon IB, generating the above described fabric tape 153' with print in this modification.

The inventors and the like of this application discovered that, in the configuration of this modification, it is possible to strike the above described balance between improving the print quality and decreasing the durability by setting the melting point of the overall ink layer 155*c'* to 60° C. or more and 90° C. or less (80° C. in this modification, for example) in the same way as the overcoat layer 155*a* in the above described embodiment. In particular, similar to the above described embodiment, if high-speed printing that is 100 [mm/sec] or higher is performed, for example, the above described print quality improvement effect is remarkable.

Further, similar to the above described embodiment, as a result of further studies on the weight ratio of the wax component included in the ink layer 155*c*', the inventors and the like of this application confirmed that it is possible to reliably improve the adherence to the transfer target while suppressing decreases in abrasion resistance by setting the weight ratio of the wax component to 50 [%] or more and 70 [%] or less.

(2) Other

Note that, in the above, the arrows shown in FIG. 5 denote an example of signal flow, but the signal flow direction is not limited thereto.

Further, other than that already stated above, techniques based on the above described embodiments and each of the modifications may be suitably utilized in combination as well.

What is claimed is:

1. An ink ribbon, comprising:

a ribbon base layer;

an undercoat layer that is configured to melt by heat reception and to separate from said ribbon base layer and is disposed on a first surface of said ribbon base layer;

a back coat layer that functions as a heat-resistant coat and is disposed on a second surface of said ribbon base layer opposite to said first surface;

an ink layer that includes a pigment and is disposed on a surface of said undercoat layer opposite to said ribbon base layer; and an overcoat layer that is configured to adhere to a transfer target and is disposed on a surface of said ink layer opposite to said undercoat layer, a melting point of said overcoat layer ranging from 60 [° C.] to 90 [° C.].

2. The ink ribbon according to claim 1, wherein said undercoat layer includes a hot melt resin selected from the group consisting of an olefinic-based copolymer resin, an elastomer, a polyisobutylene, a polybutene, and a combination thereof.

3. The ink ribbon according to claim 1, wherein a weight ratio of a wax component included in said overcoat layer ranges from 50% to 70%.

4. The ink ribbon according to claim 3, wherein said wax component includes at least one of a natural wax, petroleum wax, and synthetic wax.

5. The ink ribbon according to claim 1, wherein said ribbon base layer is a film selected from the group consisting of polyethylene naphthalate (PEN), polyarylate (PAR), and polybutylene terephthalate (PBT).

6. An ink ribbon, comprising:

a ribbon base layer;

an undercoat layer that is configured to melt by heat reception and to separate from said ribbon base layer and is disposed on a first surface of said ribbon base layer;

a back coat layer that functions as a heat-resistant coat and is disposed on a second surface of said ribbon base layer opposite to said first surface; and an ink layer with an adhering function that includes a pigment, is configured to adhere to the transfer target, and is disposed on a surface of said undercoat layer opposite to said ribbon base layer, a melting point of said ink layer with the adhering function ranging from 60 [° C.] to 90 [° C.].

7. The ink ribbon according to claim 6, wherein said undercoat layer includes a hot melt resin selected from the group consisting of an olefinic-based copolymer resin, an elastomer, a polyisobutylene, a polybutene, and a combination thereof.

8. The ink ribbon according to claim 6, wherein a weight ratio of a wax component included in said ink layer with the adhering function ranges from 50 to 70%.

9. The ink ribbon according to claim 8, wherein said wax component is selected from the group consisting of natural wax, petroleum wax, synthetic wax, and a combination thereof.

10. The ink ribbon according to claim 6, wherein said ribbon base layer is a film selected from the group consisting of polyethylene naphthalate (PEN), polyarylate (PAR), and polybutylene terephthalate (PBT).

11. A ribbon cartridge comprising:

an ink ribbon roll with an ink ribbon wound around an axis; and a support member that rotatably supports said ink ribbon roll;

said ink ribbon comprising:

a ribbon base layer;

an undercoat layer that is configured to melt by heat reception and to separate from said ribbon base layer and is disposed on a first surface of said ribbon base layer;

a back coat layer that functions as a heat-resistant coat and is disposed on a second surface of said ribbon base layer opposite to said first surface;

an ink layer that includes a pigment and is disposed on a surface of said undercoat layer opposite to said ribbon base layer; and an overcoat layer that is configured to adhere to a transfer target and is disposed on a surface of said ink layer opposite to said undercoat layer, a melting point of said overcoat layer ranging from 60 [° C.] to 90 [° C.].

12. A printer comprising:

a first storage part configured to store a medium cartridge comprising a recording medium roll with a long recoding medium wound around an axis, and a first support member that rotatably supports said recording medium roll;

a second storage part configured to store a ribbon cartridge comprising an ink ribbon roll with an ink ribbon wound around an axis, and a second support member that rotatably supports said ink ribbon roll;

a feeder configured to feed said recording medium fed out from said recording medium roll of said medium cartridge;

a printing head configured to form desired print by heat transfer printing using said ink ribbon fed out from said ink ribbon roll on said recording medium fed by said feeder to establish a long recorded medium;

a winding device configured to sequentially wind said recorded medium generated by said printing head around an outer peripheral area to form a recorded medium roll; and a controller configured to control said feeder and said printing head in coordination, said ink ribbon comprising:

a ribbon base layer;

an undercoat layer that is configured to melt by heat reception and to separate from said ribbon base layer and is disposed on a first surface of said ribbon base layer;

a back coat layer that functions as a heat-resistant coat and is disposed on a second surface of said ribbon base layer opposite to said first surface;

an ink layer that includes a pigment and is disposed on a surface of said undercoat layer opposite to said ribbon base layer; and an overcoat layer that is configured to adhere to a transfer target and is disposed on a surface of said ink layer opposite to said undercoat layer, a melting point of said overcoat layer ranging from 60 [° C.] to 90 [° C.].

13. The printer according to claim 12, wherein said controller is configured to control said feeder and said printing head in coordination so that a printing speed for said recording medium ranges from 100 [mm/sec] to 200 [mm/sec].

14. The printer according to claim 12, wherein said recording medium fed out from said recording medium roll of said medium cartridge is a recording fabric medium that is satin-weaved ranging from 6-end satin to 10-end satin using a warp thread along a medium longitudinal direction and a weft thread along a direction orthogonal to the medium longitudinal direction, and has a weaving density of said warp thread ranging from 300 [threads/inch] to 540 [threads/inch] and a weaving density of said weft thread ranging from 80 [threads/inch] to 540 [threads/inch], and is subjected to calender processing, and comprises a print-receiving surface having print formation by heat transfer printing of said second layer of said ink ribbon that received heat from said printing head, wherein said warp thread is more exposed than said weft thread by said satin weave on said print-receiving surface; and said printing head is configured to form desired print by heat transfer printing of said second layer of said ink ribbon fed out from said ink ribbon roll on said print-receiving surface of said recording fabric medium fed by said feeder to establish a long recorded fabric medium.

15. The printer according to claim 14, wherein a thickness of said warp thread of said recording fabric medium ranges from 30 [deniers] to 90 [deniers], and a thickness of said weft thread of said recording fabric medium ranges from 30 [deniers] to 90 [deniers].

* * * * *